US006135216A

United States Patent [19]

Lyon et al.

[11] Patent Number: 6,135,216

[45] Date of Patent: Oct. 24, 2000

[54] VENTING AND SEALING SYSTEM FOR DOWN-HOLE DRILLS

[75] Inventors: Leland H. Lyon; Richard K. Smith, both of Roanoke, Va.

[73] Assignee: Ingersoll-Rand Company, Woodcliff Lake, N.J.

[21] Appl. No.: 09/292,516

[22] Filed: Apr. 15, 1999

[51] Int. Cl.[7] ..... E21B 4/14

[52] U.S. Cl. ..... 175/296; 91/317

[58] Field of Search ..... 175/92, 293, 296, 175/100, 215, 320; 173/78, 79, 73, 80, 17, 139, 105; 91/317, 318, 319, 325

[56] References Cited

U.S. PATENT DOCUMENTS

| | | |
|---|---|---|
| 5,085,284 | 2/1992 | Fu . |
| 5,301,761 | 4/1994 | Fu et al. . |
| 5,562,170 | 10/1996 | Wolfer et al. . |
| 5,566,771 | 10/1996 | Wolfer et al. . |
| 5,711,205 | 1/1998 | Wolfer et al. . |

*Primary Examiner*—Robert E. Pezzuto
*Attorney, Agent, or Firm*—Mark A. Ussai

[57] ABSTRACT

A sealing and venting system including an improved piston is for a drill assembly. The drill assembly includes a fluid distributor within the casing with an elongated guide portion having an outer surface, a passage through the guide portion and a port between the outer surface and the passage. The improved piston is slidable within the casing and has an interior surface disposeable about the outer surface of the guide portion. A valve chamber, an exhaust chamber and a drive chamber are defined within the casing. The system includes a sealing surface disposed within the piston passage and slidably engageable with the outer surface of the guide portion to provide a seal between the piston and the distributor. The sealing surface prevents fluid communication between the drive chamber and the exhaust chamber when the sealing surface engages the outer surface of the guide portion, and is provided by an interior surface section of the piston body or by a separate ring seal. Further, an exhaust passage is defined by sections of the interior surface of the piston and of the outer surface of the guide portion when the guide portion is disposed within the piston passage, the passage extending between the sealing surface and the second end of the piston. The exhaust passage establishes fluid communication between the valve chamber and the exhaust chamber through the distributor and piston passages when the sealing surface engages the outer surface of the guide portion on one side of the distributor port.

22 Claims, 8 Drawing Sheets

VENTING AND SEALING SYSTEM FOR DOWN-HOLE DRILLS

BACKGROUND OF THE INVENTION

The present invention relates to drill assemblies, and particularly to a venting and sealing systems used with drill assemblies having fluid-actuated pistons.

Drill assemblies, particularly down-hole drills, having fluid-actuated pistons are known, such as those disclosed in U.S. Pat. Nos. 5,085,284 of Fu, 5,301,761 of Fu et al., 5,562,170 of Wolfer et al., 5,711,205 (Wolfer et al.) and 5,566,771 of Wolfer et al. As shown in FIGS. 1 and 2, a typical down-hole drill assembly 1 includes a casing 2 containing the internal components of the drill assembly 1. A piston 4 is slidably mounted within the casing 2 and is guided by an inner bearing surface 2*a* of the casing 1 so as to reciprocally impact with a drill bit 5. The drill bit 5 provides the work output of the drill assembly 1. The piston 4 moves in either a drive direction, shown by arrow 3A, or a return direction, shown by arrow 3B. A fluid supply line 6 supplies high pressure or "percussive" fluid, preferably compressed air, to a supply chamber 7, the percussive fluid providing motive force for the piston 4 as discussed below.

The following description outlines both the basic structure and operation of the drill assembly 1. When the piston 4 is in close proximity to the bit 5 (FIG. 1), a return chamber 8 is in fluid communication with the supply chamber 7 via a return supply passage 9. Any pressure in the return chamber 7 biases the piston 4 in the return direction 3B. The fluid from the supply chamber 7 continues to be supplied to the return chamber 8 until a portion of the outer piston surface 4*e* passes across a sealing point 9*a* of the return supply passage 9. Fluid pressure in the return chamber 8 continues to accelerate the piston 4 in the return direction 3B until a lower end 4*b* of the piston 4 passes an outlet 5*b* in the bit 5. The outlet 5*b* leads into an exhaust chamber 11 formed within and extending through the bit 5, such that the pressurized fluid flows out of the return chamber 8 and into the chamber 11. However, the momentum of the piston 4 is such that the piston 4 continues moving in the return direction 3B.

At a certain point of the movement in the return direction 3B, the upper end 4*a* of the piston 4 engages the end 14*b* of an elongated guide portion 14 of a fluid distributor 15, which enters into and seals off a piston passage 4*c* (see upper portion of FIG. 2). After this point, percussive fluid in a drive chamber 13 above the piston 4 becomes compressed and increases in pressure as the volume of the chamber 13 decreases due to movement of the piston 4. The increasing drive chamber pressure decelerates movement of the piston 4 in the return direction 3B. Further, a pressure sensitive valve 16 regulates fluid flow through a distributor supply passage 17 that extends between the supply chamber 7 and the drive chamber 13. The distributor 15 also includes a distributor valve passage 20 and a distributor port 21 extending between the outer surface 14*a* of the guide portion 14 and the passage 20. Flow communication between a valve control chamber 19 (discussed below) and the drive chamber 13 is established through the distributor port 21 and the passage 20.

As best shown in FIG. 2, the valve 16 has three pressure surfaces, surfaces 16*a*, 16*b* and 16*c*. The first valve surface 16*a* is exposed to the pressure in the supply chamber 7, which tends to bias the valve 16 toward a valve seat portion 18 of the distributor 15 (i.e., to "close" the valve 16). When disposed adjacent the seat 18, the valve 16 obstructs the supply passage 17 and thereby prevents fluid communication between the supply chamber 7 and the drive chamber 13. The second valve surface 16*b* is exposed to pressure in the drive chamber 13 (through the supply passage 17), which tends to bias the valve 16 away from the valve seat 18 (i.e., to "open" the valve 16) and thereby establish flow communication between the supply chamber 7 and the drive chamber 13 through the distributor supply passage 17. The third valve surface 16*c* is exposed to pressure in the valve control chamber 19, which also tends to bias the valve 16 toward the valve seat 18.

As described above, movement of the piston 4 after engaging with the guide portion 14 causes the drive chamber pressure to increase. The increasing drive chamber pressure eventually causes the pressure acting on the second valve surface 16*b* to exceed the pressure acting on the first and third valve surfaces 16*a*, 16*c*, respectively. This pressure differential gives rise to a net force on the valve 16 that displaces the valve 16 from the valve seat 18 and thereby opens the distributor supply passage 17. Opening of the supply passage 17 enables high pressure percussive fluid to flow from the supply chamber 7 and into the drive chamber 13. The resulting pressure increase in the drive chamber 13 first halts the return travel of the piston 4, and then rapidly accelerates the piston 4 in the drive direction 3A.

As piston 4 travels in the drive direction 3A, the upper end 4*a* of the piston 4 passes the distributor port 21 such that pressurized fluid in the drive chamber 13 flows into the valve chamber 19 (via distributor port 21 and the distributor passage) to increase the pressure on the third valve surface 16*c*. Further, as the upper end 14*a* of the piston 14 passes the end 14*b* of the distributor guide portion 14, high pressure percussive fluid flows from the drive chamber 13 through the piston passage 4*c* and to the exhaust chamber 11. The resultant pressure decrease in the drive chamber 13, coupled with the pressure increase in the valve chamber 19, causes the valve 16 to be biased toward the valve seat 18 and thereby cut-off the flow of pressurized air from the supply chamber 7 to the drive chamber 13. The piston 4 then impacts with the bit 5 and the above-described cycle of movement of the piston 4 is repeated numerous times during operation of the drill assembly 1.

The operation of known drill assemblies, as discussed above, is adversely affected by inadequate control over the pressure in the valve control chamber 19. After the upper end 4*a* of the piston 4 passes over the distributor port 21, there should be no fluid communication between the drive chamber 13 and the valve chamber 19 as any increase in valve chamber pressure will prevent the valve 16 from opening in a timely manner. To prevent such fluid flow, the clearance between the interior surface 4*d* of the piston 4 and the outer surface 14*a* of the guide portion 14 must be negligible. Therefore, the piston interior surface 4*d* necessarily contacts and slides along the outer surface 14*a* of the guide portion 14, such that lubrication is required to minimize the adverse effects of metal-to-metal contact.

After a certain period of use of the drill assembly 1, wearing or galling of the piston interior surface 4*d* and the guide outer surface 14*a* inevitably occurs, such that the clearance increases. Thereafter, pressurized fluid from the drive chamber 13 flows or "leaks" between the surfaces 4*d* and 14*a*. The leakage flow causes a loss of pressure in the drive chamber 13, but more significantly, this flow enters the distributor port 21 and flows to the valve chamber 19. The resulting increase in valve chamber pressure increases the pressure acting on the third valve surface 16*c*, and thereby increases the minimum drive chamber pressure necessary to open the valve 16. Thus, as the percussive fluid in the drive chamber 13 must be compressed to a greater extent to achieve the increased pressure required, the valve 16 opens later in the piston movement cycle than desired.

One attempt to solve the above-described problem is to add a valve vent 12 to the fluid distributor 15. The valve vent 12 extends between the distributor passage 20 and an axial passage 22 through the distributor 15, the axial passage 22 being in fluid communication with the exhaust chamber 11 of the drill assembly 1. Excessive pressure in the valve control chamber 19 caused by fluid leaking between the piston interior surface 4*d* and the valve outer surface 14*a* is thereby directed through the valve vent 12 and to the exhaust chamber 11. The cross-sectional area of the valve vent 12 must be sufficiently large to enable the leakage flow from the drive chamber 13 to be vented sufficiently rapidly so that the valve chamber pressure does not increase.

However, the addition of the valve vent 12 to the fluid distributor 15 has been found to create a different problem. If the valve vent 12 is too large, percussive fluid that must be supplied to the valve chamber 19 during downward movement of the piston 4 (i.e., in the drive direction 3A) flows through the valve vent 12 instead of to the valve control chamber 19. The diversion of the fluid from the valve chamber 19, which is necessary to close the valve 16 when the piston 4 approaches the bit 5, prevents the valve 16 from closing at a desired point in the cycle of the piston movement.

In view of the above-discussed limitations with known down-hole drill assemblies 1 having fluid-actuated pistons, it would be desirable to have a venting and sealing system whereby the flow area for evacuating pressurized fluid from the valve chamber 19 to the exhaust chamber 11 was very large when the valve 16 must open (at or near the top of the stroke) and is zero or significantly small when the valve 16 must close (near the bottom of the stroke). It would also be desirable to significantly diminish, and preferably eliminate, the loss of pressurized fluid between the piston interior surface 4*d* and the outer surface 14*a* of the distributor guide portion 14 so as to improve the air consumption efficiency of the drill assembly 1. Further, it would also be desirable to provide a sealing system to reduce reliance on precision clearances between the piston 4 and the guide portion 14, such that the clearance therebetween is essentially negligible but the surfaces 4*d* and 14*a* were not prone to wear. Finally, it would be desirable to provide a system for sealing the space between the piston 4 and the distributor 15 which eliminated the need for oil or other lubrication to prevent metal-to-metal galling and wear, and thus permit lube-free operation of the drill assembly 1.

SUMMARY OF THE INVENTION

In one aspect, the present invention is a venting and sealing system for a drill assembly. The drill assembly includes a casing and a fluid distributor disposed within the casing and including an elongated guide portion having an outer surface. A piston is slidably disposed within the casing and has first and second ends and an interior surface defining a passage between the piston ends, the piston interior surface being disposeable about the outer surface of the guide portion. The system includes a sealing surface disposed within the piston passage and slidably engageable with the outer surface of the guide portion so as to provide a seal between the piston and the distributor. An exhaust passage is defined by sections of the interior surface of the piston and of the outer surface of the guide portion when the guide portion is disposed within the piston passage, the passage extending between the sealing surface and the second end of the piston.

In another aspect, the present invention is also a venting and sealing system for a drill assembly. The drill assembly includes a casing and a fluid distributor disposed within the casing and including an elongated guide portion having an outer surface, a passage extending through the guide portion and a port extending between the outer surface of the guide portion and the passage. A piston is slidably disposed within the casing and has first and second ends and an interior surface defining a passage between the piston ends, the piston interior surface being disposeable about the outer surface of the guide portion. A valve chamber is defined within the casing and is in fluid communication with the distributor passage. Also, an exhaust chamber is defined within the casing and is in fluid communication with the piston passage. Further, a drive chamber is fluidly communicable with the valve chamber and the exhaust chamber. The venting and sealing system includes a sealing surface disposed within the piston passage and slidably engageable with the outer surface of the guide portion. An exhaust passage is located between the interior surface of the piston and the outer surface of the guide portion extends between the sealing surface and the second end of the piston. The sealing surface substantially prevents fluid communication between the drive chamber and exhaust chamber when the sealing surface engages the outer surface of the guide portion on a first side of the distributor port. The exhaust passage establishes fluid communication between the valve and exhaust chambers through the distributor and piston passages when the sealing surface engages the outer surface of the guide portion on a second, opposing side of the distributor port.

In yet another aspect, the present invention is a piston for a drill assembly including a fluid distributor, the distributor including an elongated guide portion having an outer surface. The piston includes a body having a first end, a second end and an interior surface defining a passage extending between the two ends, the interior surface being disposeable about the outer surface of the guide portion. The interior surface includes a first surface section located proximal to the first end of the body, having a generally cylindrical shape and a generally constant inner diameter, and being slidably engageable with the guide portion outer surface so as to provide a seal between the piston and the distributor. The interior surface also includes a second surface section located between the first surface section and the second end of the body and having at least one inner diameter, the second section inner diameter being greater than the first section inner diameter.

In an even further aspect, the present invention is also a piston for a drill assembly including a casing and an elongated guide member having an outer surface. The piston includes a body having a first end, a second end and an interior surface defining a passage extending between the first and second ends. The interior surface is disposeable about the outer surface of the guide member. A ring seal is disposed within the piston passage and has a sealing surface slidably engageable with the outer surface of the guide member so as to provide a floating seal between the piston and the guide member.

In a final aspect, the present invention is also venting and sealing system for a drill assembly. The drill assembly includes a casing, a fluid distributor disposed within the casing and including an elongated guide portion having an outer surface and a passage extending through the guide portion. A piston is slidably disposed within the casing and has first and second ends and an interior surface defining a passage between the piston ends, the piston interior surface being disposable about the outer surface of the guide portion. A valve chamber in fluid communication with the distributor passage and an exhaust chamber is in fluid communication with the piston passage. Further, a valve is contactable with the distributor and exposed to the valve chamber. The system includes sealing means for substantially preventing fluid communication between the drive chamber and the exhaust chamber when the piston is at a first, distal position with respect to the valve. Further, the system includes passage means for establishing fluid communication between the valve chamber and the exhaust chamber when the piston is at a second, proximal position with respect to the valve.

BRIEF DESCRIPTION OF THE SEVERAL VIEWS OF THE DRAWINGS

The foregoing summary, as well as the detailed description of the preferred embodiments of the invention, will be better understood when read in conjunction with the appended drawings. For the purpose of illustrating the invention, there is shown in the drawings, which are diagrammatic, embodiments that are presently preferred. It should be understood, however, that the invention is not limited to the precise arrangements and instrumentalities shown. In the drawings.

DETAILED DESCRIPTION OF THE INVENTION

Figure 1:
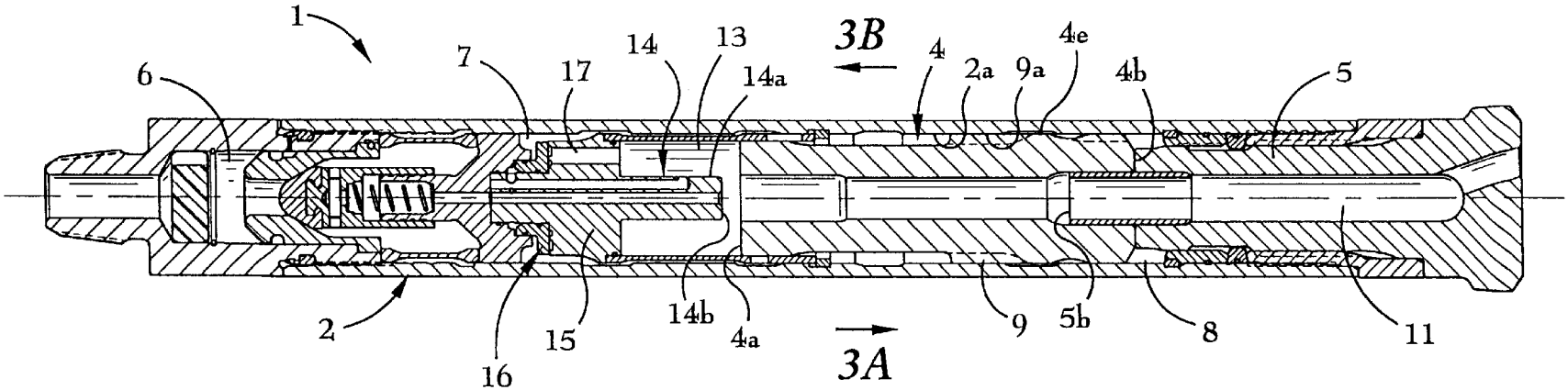
Fig. 1 (Prior Art)
FIG. 1 is a cross-sectional side view of a typical downhole drill assembly having a known venting and sealing system.

Certain terminology is used in the following description for convenience only and is not limiting. The words "right", "left", "lower", "upper", "upward", "down" and "downward" designate directions in the drawings to which reference is made. The words "front", "frontward" and "rear", "rearward" refer to directions toward and away from, respectively, a designated front section of a drill assembly, a piston or a specific portion of either, the particular meaning intended being readily apparent from the context of the description. The words "inner", "inward" and "outer", "outward" refer to directions toward and away from, respectively, the geometric center of the drill assembly, the piston or a particular portion of either, as will be apparent from the context of the description. The terms "radial" and "radially-extending" refer to directions generally perpendicular to a designated axis, and refer both to elements that are either partially or completely oriented in radial direction. The terminology includes the words specifically mentioned above, derivatives thereof, and words of similar import.

Referring now to the drawings in detail, wherein like numbers are used to indicate like elements throughout, there is shown in FIGS. 3–10 a presently preferred embodiment of a venting and sealing system 30, including an improved piston 32, for a drill assembly 1. The drill assembly 1 includes a casing 2 and a fluid distributor 15 disposed within the casing 2. The distributor 15 includes an elongated guide portion 14 having an outer surface 14*a*. A valve passage 20 extends through the guide portion 14 and a port 21 extends between the outer surface 14*a* of the guide portion 14 and the distributor passage 21. The piston 32 is slidably disposed within the casing 1 and has first and second ends, 32*a*, 32*b*, respectively, and an interior surface 34. The piston interior surface 34 defines a passage 33 between the piston ends 32*a*, 32*b* and is disposeable about the outer surface 14*a* of the guide portion 14. The drill assembly 1 further includes a valve chamber 19 defined within the casing 2 and in fluid communication with the distributor passage 21, an exhaust chamber 11 (See FIG. 10) defined within the casing 2 and in fluid communication with the piston passage 33, and a drive chamber 13 fluidly communicable with the valve chamber 19 and with the exhaust chamber 11.

The venting and sealing system 30 basically comprises a sealing surface 36 disposed within the piston passage 33 and slidably engageable with the outer surface 14*a* of the guide portion 14. A valve chamber exhaust passage 38 extends between the interior surface 34 of the piston 32 and the outer surface 14*a* of the guide portion 14 and extends between the sealing surface 36 and the second end 32*b* of the piston 32. More specifically, the exhaust passage 38 is defined by sections of the interior surface 34 of the piston 32 and of the outer surface 14*a* of the distributor guide portion 14 when the guide portion 14 is disposed within the piston passage 33.

Figure 4:
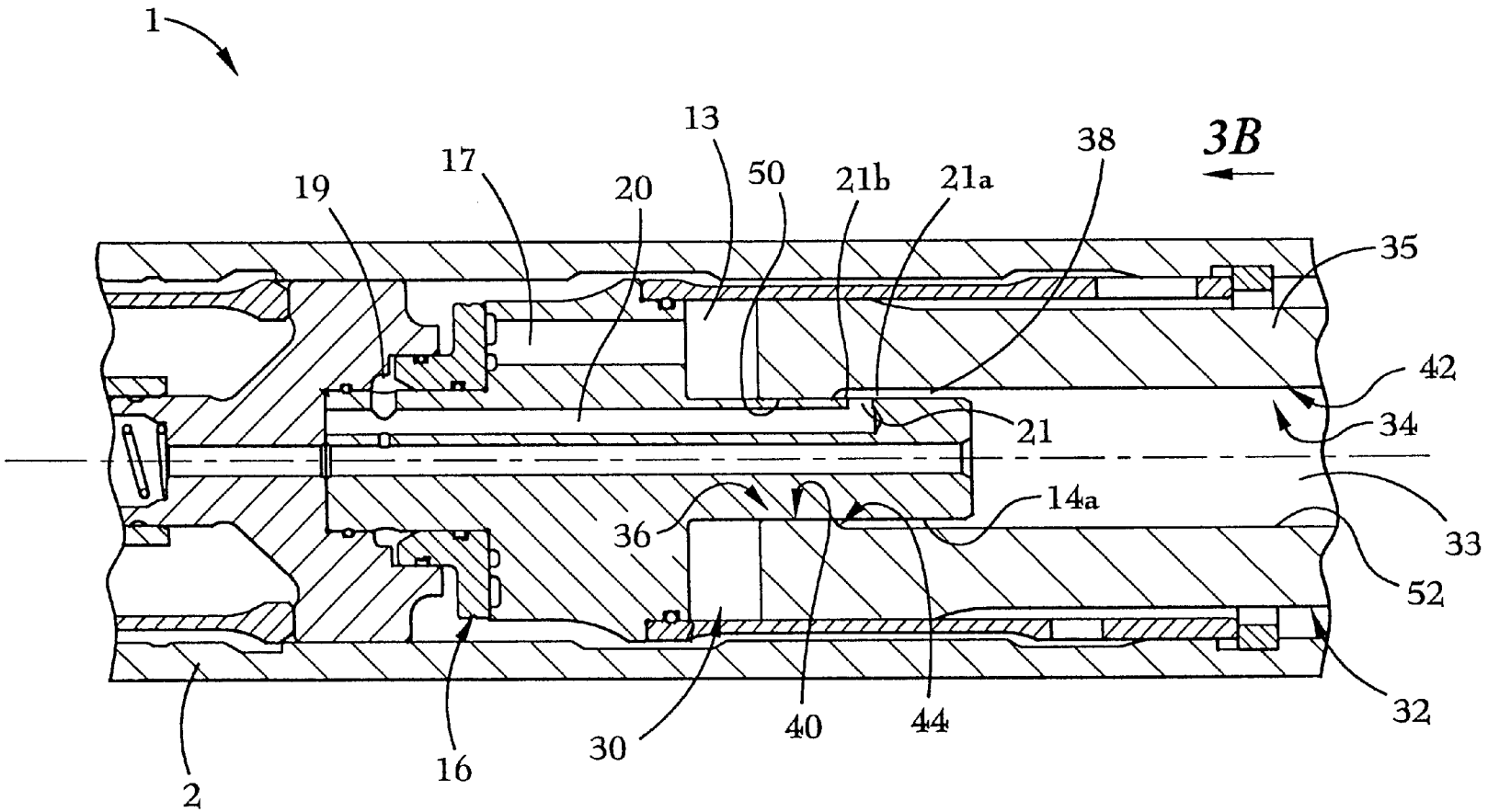
FIG. 4 is another view of the system depicted in FIG. 3, showing the piston moving in the return direction with the sealing surface in a valve chamber venting position.
Figure 5:
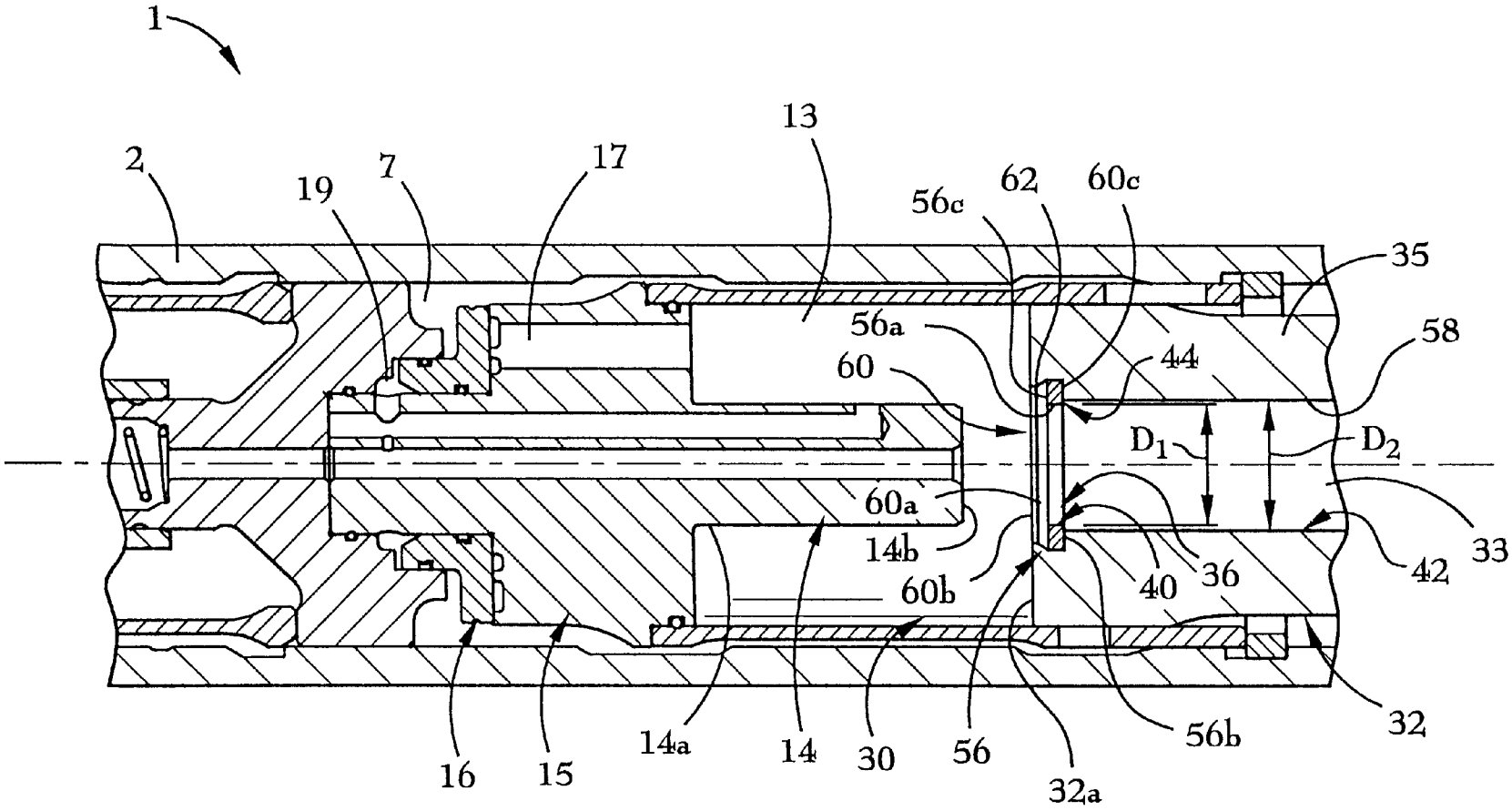
FIG. 5 is a broken-away, enlarged cross-sectional side view of the venting and sealing system in accordance with the present invention, showing a second construction of an improved piston.
Figure 6:
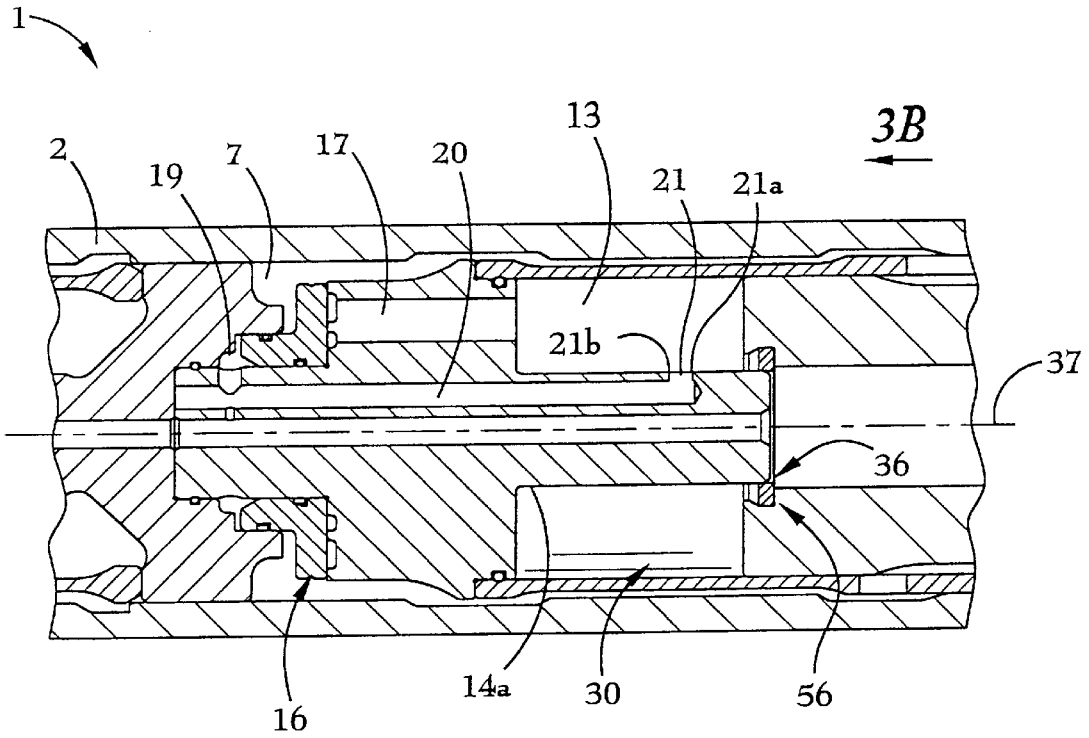
FIG. 6 is another view of the system depicted in FIG. 5, showing the piston moving in the return direction with the seal engaged with the distributor.
Figure 7:
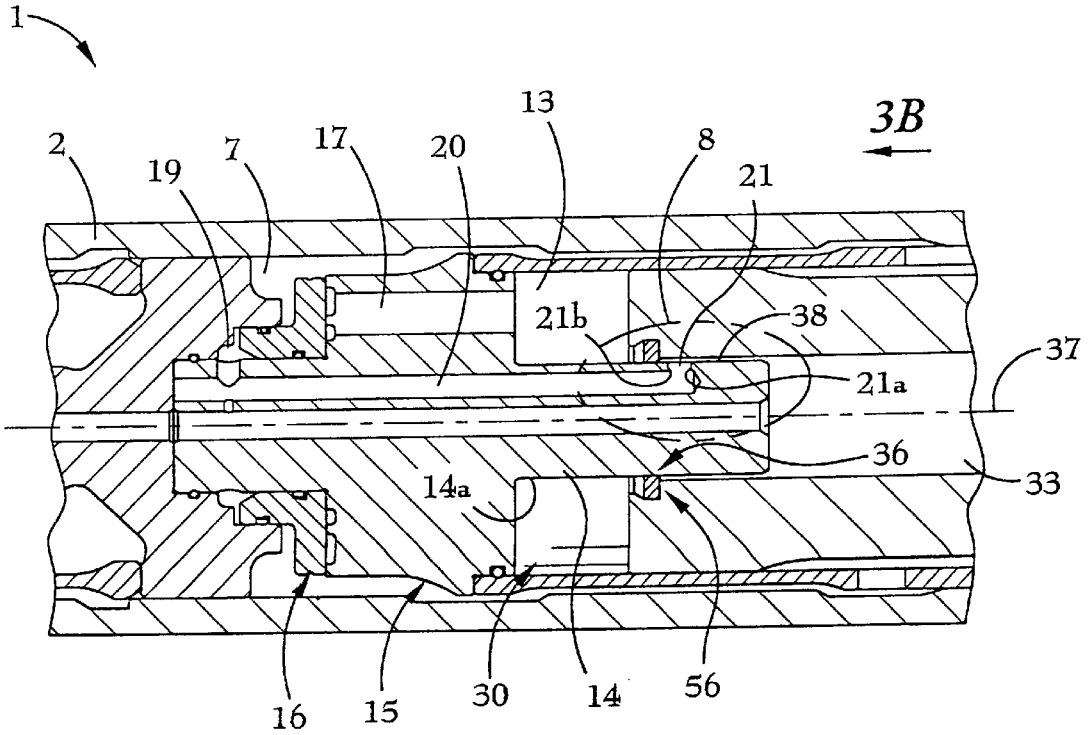
FIG. 7 is another view of the system depicted in FIG. 5, showing the piston moving in the return direction with the sealing surface in a valve chamber venting position.

As shown in FIGS. 4–9, the sealing surface 36 substantially prevents fluid communication between the drive chamber 13 and the exhaust chamber 11 (FIG. 10) when the sealing surface 36 engages the outer surface 14*a* of the guide portion 14 (e.g., FIG. 5). Further, the exhaust passage 38 establishes fluid communication between the valve chamber 19 and the exhaust chamber 11, through the distributor and piston passages 20, 33, respectively, when the sealing surface 36 engages the outer surface 14*a* of the guide portion 14 on a second, opposing side 21*b* of the distributor port 21 (FIGS. 6 and 7). In other words, when the piston 32 first engages the distributor 15 at a first or distal position with respect to the valve 16 (e.g., FIG. 5), the sealing surface 36 seals the drive chamber 13 from the exhaust chamber 11 so that the drive chamber pressure increases as the piston 32 moves in the return direction 3B, and then as the piston 32 moves to a second or proximal position with respect to the valve 16, the exhaust passage 38 enables venting of the valve chamber 19 (FIGS. 4 and 7). Each of the above-recited elements of the venting and sealing system 30 is described in further detail below.

Figure 3:
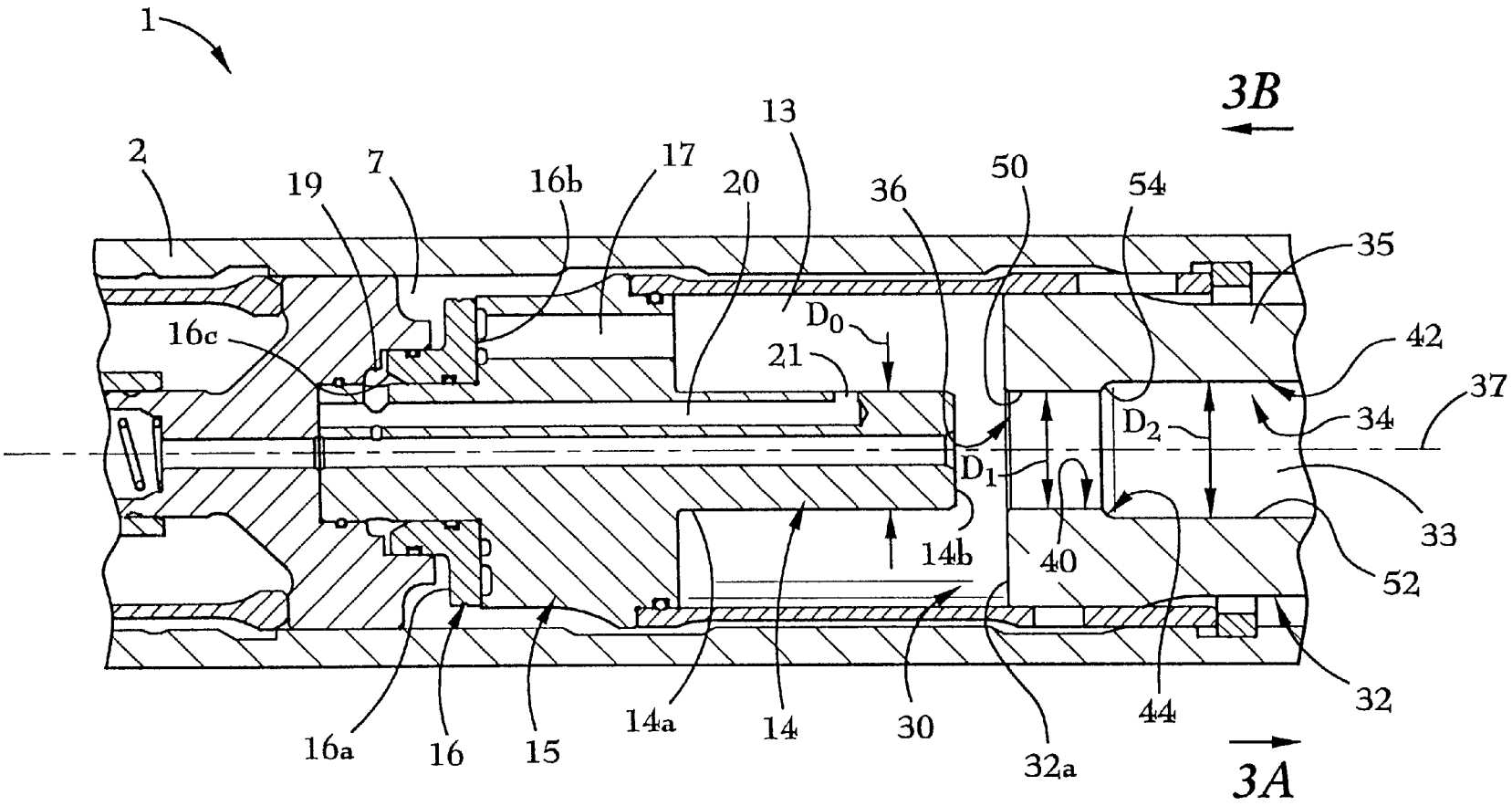
FIG. 3 is a broken-away, enlarged cross-sectional side view of a venting and sealing system in accordance with the present invention, showing a first construction of an improved piston.
Figure 10:
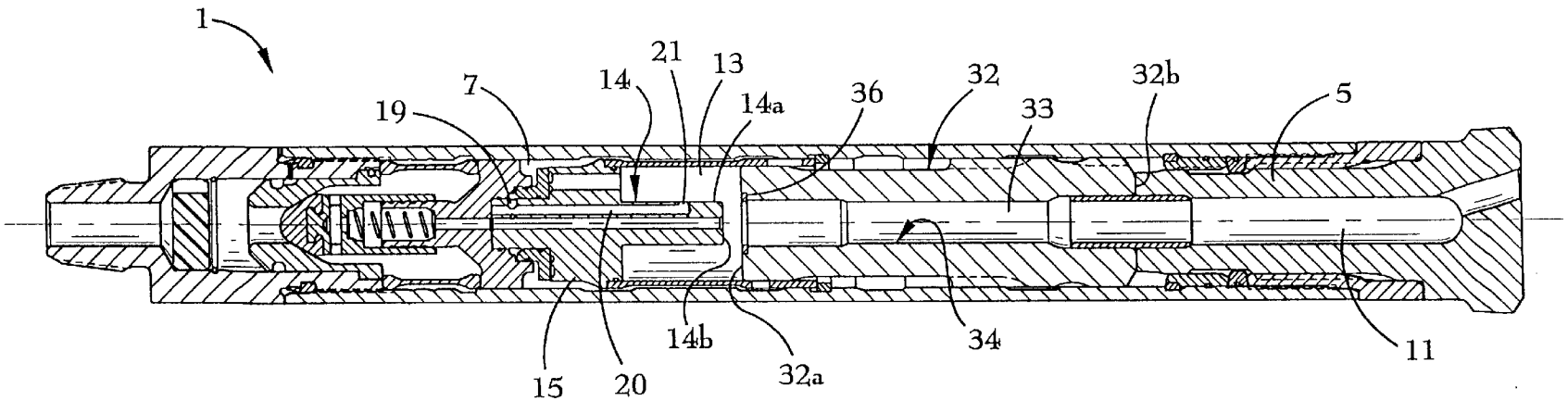
FIG. 10 is a cross-sectional side view of the drill assembly having the venting and sealing system of the present invention, depicting the second piston construction.

Referring particularly to FIGS. 3, 5 and 10, the improved piston 32 basically comprises a cylindrical body 35 with a central axis 37 including the first end 32*a*, the second end 32*b* and the interior surface 34 of the piston 32, as discussed above. The piston interior surface 34 provides both the sealing surface 36 and the portions of the piston 32 that, in conjunction with the distributor outer surface 14*a*, define the exhaust passage 38. More specifically, the piston interior surface 34 includes a first circumferential surface section 40 located proximal to the first end 32*a* of the piston 32, which has a generally cylindrical shape and a generally constant inner diameter $D_1$ (FIGS. 3 and 5). The first surface section 40 provides the sealing surface 36 and is preferably generally centered about the central axis 37. The piston interior surface 34 further includes a second circumferential surface section 42 located between the first surface section 40 and the second end 32*b* of the piston 32. The second surface section 42 has at least one inner diameter $D_2$, (FIGS. 3 and 5) the inner diameter $D_2$ of the second section 42 being greater than the inner diameter $D_1$ of the first section 40. In other words, the second surface section 42 is spaced from the central axis 37 so as to be disposed radially outwardly with respect to the first surface section 40.

Further, the piston interior surface 34 also includes a third, radially-extending surface section 44 located and extending between the first and second surface sections 40, 42, respectively. Preferably, the second surface section 42 extends from the third or middle surface section 44 to the second end 32*b* of the piston 32, and most preferably, has a constant inner diameter $D_2$ along the entire length thereof. Alternatively, the piston interior surface 34 may include fourth and fifth surface sections 37, 39, respectively, extending from the second section 42 toward the second piston end 32*b* and each having a diameter (not indicated) less than the second section 42, which may even be less than an outer diameter of the distributor guide portion 14 at sections where the guide portion 14 does not enter into the piston passage 33. Such additional sections 37, 39 may be desirable in order to minimize the amount of machining or other manufacturing necessary to form the piston interior surface 34, as discussed further below, or for interacting with the bit 5. A detailed discussion of these surface sections are beyond the scope of this disclosure.

Referring now to FIGS. 4 and 7, the exhaust passage 38 is partially bounded (i.e., on two sides) by the second and third piston surface sections 42, 44, respectively. When the distributor guide portion 14 is disposed within the piston passage 33 such that the second section 42 is at least partially disposed about the guide portion outer surface 14*a*, the exhaust passage 38 is defined/bounded by the second and third inner surface sections 42, 44, respectively, and the portion of the distributor outer surface 14*a* that is "overlapped" by the piston second inner surface section 42. The exhaust passage 38 extends into the remaining portion of the piston passage 33, in other words, the portion of the piston passage 33 in which the guide portion 14 is not disposed. Thus, movement of the piston 32 in the return direction 3B causes the length of the exhaust passage 38 to increase as the length of the remaining piston passage 33 decreases by a corresponding amount. Further, movement of the piston 32 in the drive direction 3A decreases the exhaust passage length and increases the piston passage length.

Referring specifically to FIGS. 3 and 4, a first construction of the improved piston 32 has a cylindrical body 35 formed such that the first, second and third surface sections 40, 42, 44, respectively, of the piston interior surface 34 are provided by corresponding inner surface sections 50, 52, 54, respectively, of the body 35 itself. More specifically, the cylindrical body 35 is formed with a "stepped" configuration wherein the body first surface section 40 extends from the first end 32*a* of the piston 32 to a radial shoulder (which preferably has a radius as shown), which provides the body third surface section 44, and the body second surface section 42 is offset outwardly with respect to the first section 40 and extends from the radial shoulder to the second end 32*b* of the piston 32. Further, the body first surface section 40 includes the first inner diameter $D_1$ and the body second surface section 42 includes the second section inner diameter $D_2$. Preferably, the body second section 42 is formed with the inner diameter $D_2$ being generally constant along the length thereof (i.e., from the radial shoulder to the second end 32*b* of the piston 32) although alternatively, the body second section 42 may be tapering, stepped or otherwise formed (none shown) if desired for a particular application.

Referring now to FIGS. 5–10, a second, alternative construction of the improved piston 32 includes a ring seal 56 disposed within the piston passage 33. The ring seal 56 has an inner circumferential surface 56*a* providing the sealing surface 36. Preferably, the piston body 35 includes an inner circumferential surface 58 and an annular recess 60 that extends circumferentially into the body 35 from the body inner surface 58. The ring seal 56 is disposed within the annular recess 60 and includes a radial surface 56*b* extending from the recess 60 and into the piston passage 33 and which faces generally toward the second end 32*b* of the piston 32, the purpose for which is discussed below.

Preferably, the ring seal 56 is formed as generally circular, integral ring (i.e., without a radial split) having a generally rectangular radial cross-section. Alternatively, the ring seal 56 may be formed of any other appropriate manner, such as for example, having a circular or frusta-conical radial cross section, as long as the venting and sealing system 30 is capable of functioning as described above and below. Further, the ring seal 56 is preferably constructed of a material having a sufficiently low modulus of elasticity such that a pressure differential acting on the ring seal 56, as discussed below, is sufficient to cause radial inward contraction of the ring 56. Radial contraction of the ring seal 56 is desirable as the contraction causes the ring seal 56 to exert contact pressure against the outer surface 14*a* of the guide portion 14, which increases sealing efficiency. Alternatively, the ring seal 56 may be constructed of a material that does not radially contract an appreciable amount during operation of the drill assembly 1 as the present invention operates effectively without this feature.

However, the ring seal material is preferably selected to have sufficient rigidity such that the pressure differential between the drive chamber 13 and the exhaust chamber 11 existing when the seal 56 disengages from the distributor 15 does not cause the ring seal 56 to radially contract to the extent that the ring seal 56 "collapses" and is pulled from the annular recess 60. Furthermore, the material of the ring seal 56 preferably has high abrasion resistance to minimize wearing-away of the sealing surface 36, and thus reducing sealing efficiency, which may occur during sliding engagement with the distributor outer surface 14*a*.

Figure 8:
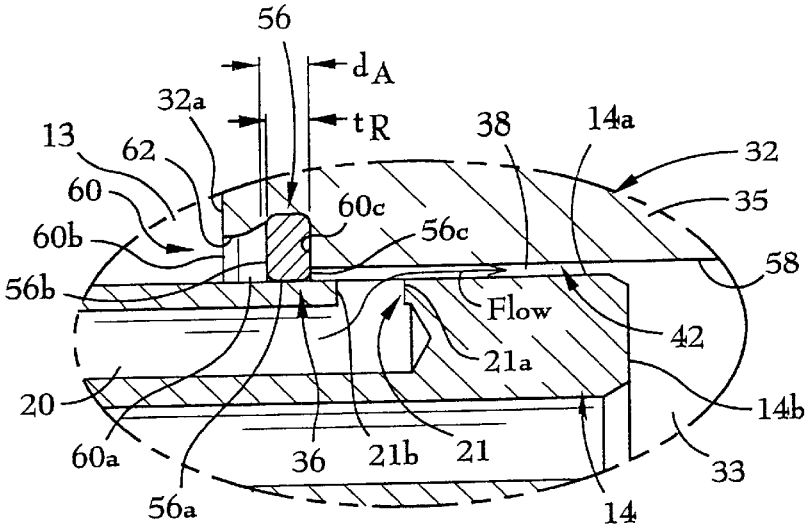
FIG. 8 is a greatly enlarged view of the section designated as "8" in FIG. 7.

Referring now to FIGS. 5 and 8, the annular recess 60 preferably extends into the body 35 from the first end 32*a* of the piston 32 such that the recess 60 is configured as a "gland" having both a circumferential opening section 60*a* and a radial opening section 60*b*. With this preferred construction, the body 35 preferably includes a radially-extending, circumferential lip 62 which provides a surface to frictionally lock or "snap-fit" the ring seal 56 within the recess 60. The preferred ring seal 56, formed as an integral ring as discussed above, is installed in the recess 60 by being pressed through the radial opening section 60*b* and over the lip 52.

Preferably, the annular recess 60 is formed such that inner diameter of the recess 60 is greater than the outer diameter of the seal ring 56 (neither diameter designated) and the axial distance $d_A$ between the lip 62 and an inner radial wall 60*c* of the recess 60 is greater than the thickness $t_R$ of the ring 56 (see FIG. 8). The relative sizing of the recess 60 and the ring seal 56 enables the seal 56 to move both axially and radially within the recess 60 such that the ring seal 56 is "floating". By forming the recess 60 such that the ring seal 56 floats therein, the clearance between the piston 32 and distributor guide portion 14 may be increased so that the axial alignment between the piston 32 and the distributor 15 is less critical to proper operation of the drill assembly 1. In other words, the ring seal 56 is able to move within the recess 60 to align the inner surface 56*a* (i.e., the sealing surface 36) of the ring seal 56 with the outer surface 14*a* of the distributor guide portion 14, even if the guide portion 14 and the piston 32 are not precisely co-axial. Further, with a floating ring seal 56, the above-discussed pressure differential acting on the seal 56 also causes (i.e., besides radial contraction) the inner face of the ring 56 to exert pressure against the recess radial wall 60*c* to seal the space therebetween.

Alternatively, the annular recess 60 may be formed such that the ring seal 56 is retained therein by friction arising by compressive forces acting on portions of the opposing radial surfaces 56*b*, 56*c* by the lip 62 and the inner radial wall 60*c* of the recess 60. As a further alternative, the annular recess 60 may be spaced from the first end 32*a* of the piston 32, such that the recess 60 only has a circumferential opening (not shown), in which case the ring seal 56 is preferably formed as a split ring. Furthermore, although not preferred, the second construction of the piston 32 may be constructed without an annular recess 60, with the ring seal 56 being attached directly to the interior surface 58 of the body 35 by appropriate means, such as with an adhesive substance or with fasteners. The present invention embraces these and all other all known alternative structures for mounting the ring seal 56 within the second construction improved piston 32.

Referring again to FIGS. 5–10, unlike the first piston construction having three body surfaces 50, 52 and 54 providing the three functional surface sections 40, 42, and 44 (as best shown in FIG. 3) of the piston interior surface 34, the ring seal 56 itself provides/defines sections of the piston interior surface 34 of the second piston construction. More specifically, the first inner surface section 40 of the piston interior surface 34 is provided by the inner circumferential surface 56*a* of the ring seal 56. Further, the section of the body inner surface 58 located between the ring seal 56 and the second end 32*b* of the piston 32 provides the second inner surface section 32 and the radial surface 56*b* provides the third surface section 44. As the ring seal 56 provides two functional surface sections 40, 44 of the piston interior surface 34, the piston body 35 may be formed such that the body inner surface 58 has a generally constant inner diameter at all sections thereof (other than at the annular recess 60) equal to the second inner diameter $D_2$, so as to minimize machining.

Preferably, both the first and second constructions of the improved piston 32 are fabricated from an alloy steel rod and having the appropriate interior surface(s), and the annular recess 60 (second construction), formed by boring and/or counter-boring operations. Further, the ring seal 56 is preferably formed of polyethylene, most preferably Ultra High Molecular polyethylene. However, it is within the scope of the present invention to fabricate either construction of the improved piston 32 of any other suitable material, such as for example stainless steel or another steel alloy and/or formed by any other appropriate manufacturing technique, such as by a combination of casting and finish machining operations. Further, it is within the scope of the present invention to fabricate the ring seal 56 of another appropriate polymeric material, such as for example nylon.

Referring now to FIGS. 1–10, all other components of the drill assembly 1 are preferably formed as described in the Background section of this application, except for the following specific differences. The fluid distributor 15 (which preferably has a cylindrical guide portion 14 with a generally constant outer diameter $D_0$ (FIG. 3) as with previous distributors) is preferably formed without a valve vent (designated as element 12 in FIG. 2). The valve vent 12 is not required as venting of pressure from the valve chamber 19 occurs through the exhaust passage 38 via the distributor valve passage 20 and distributor port 21, as discussed below. The elimination of the valve vent 12 thus prevents the loss of valve chamber pressure when such pressure is needed to assist in closing the valve 16, as discussed in further detail below.

Figure 2:
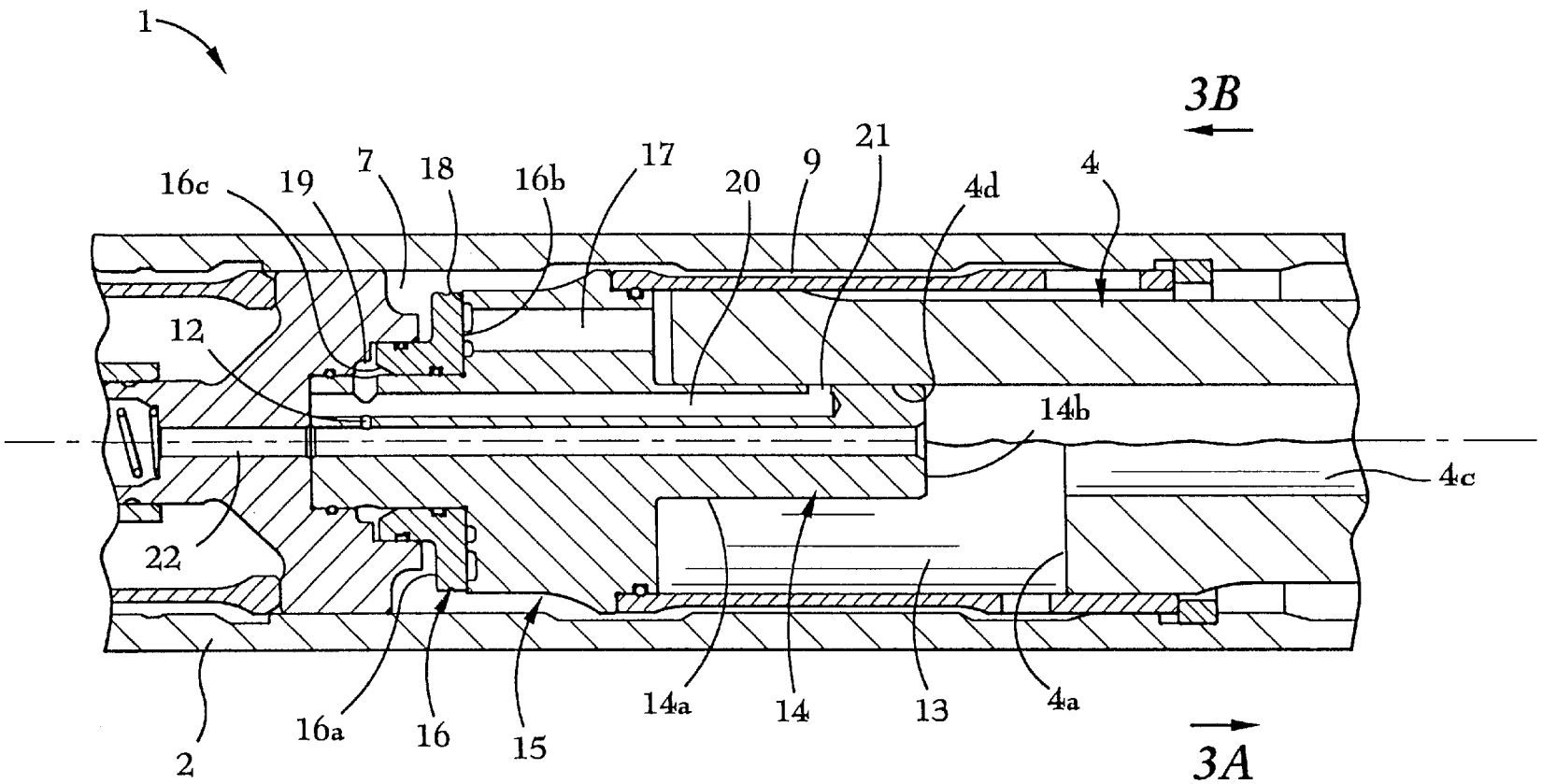
Fig. 2 (Prior Art)
FIG. 2 is a broken-away, enlarged cross-sectional side view of the venting and sealing system depicted in FIG. 1, showing a first position of the piston in the upper portion and a second position in the lower portion.

Alternatively, the distributor 15 may include a modified valve vent port (not shown), located generally as shown in FIG. 2 for valve vent 12, but having a significantly reduced cross-sectional area from that of the valve vent 12 of known venting and sealing systems. Such a valve vent may be beneficial to provide fluid communication with a drill axial passage 22 extending through the distributor 15, so as to enable the valve chamber 19, the distributor port 21 and the distributor valve passage 22 to be purged of moisture, debris and other materials that may be otherwise trapped therewithin. If such a valve vent is included in the distributor 15, it must have a sufficiently small cross-sectional area such that the only a minimal volume of fluid flow is capable of being directed through the vent to prevent "bleeding-off" of pressure during the upstroke of the piston cycle as described below.

Referring now to FIGS. 4 and 6–9, the venting and sealing system 30 of the present invention enables the drill assembly 1 to function generally as described in the Background section of this disclosure, but with the following modifications and improvements. As discussed above, when the piston 32 begins movement in the return direction 3B toward the valve 16, the piston 32 is initially spaced (i.e., vertically) from the end 14*b* of the distributor 15, the valve chamber 19 is in flow communication with the exhaust chamber 11 via the distributor valve passage 20 and the piston passage 33. As the piston 32 approaches the valve 16, the first end 32*a* of the piston 32 passes the end 14*b* of the guide portion 14 such that the guide portion 14 enters the piston passage 33 (FIG. 6).

At this point, the sealing surface 36 of the piston 32 slidably engages the outer surface 14*a* of the distributor guide portion 14 on a first side 21*a* of the port 21 and at a first, distal position with respect to the valve 16, such that a movable or "floating" seal is formed between the piston 32 and the distributor 15. The seal substantially prevents flow communication between the drive chamber 13 and the exhaust chamber 11, enabling the drive chamber pressure to increase. As the piston 32 continues moving toward the valve 16, the sealing surface 36 passes across the distributor port 21 so as to be engaged with the outer surface 14*a* of the distributor 15 on a second, opposing side 21*b* of the port 21 (FIGS. 4, 7 and 8). The sealing surface 36 substantially prevents flow communication between the drive chamber 13 and the valve chamber 19, thereby virtually eliminating any increase in valve chamber pressure caused by leakage flow from the drive chamber 13, as discussed above. Further, the valve exhaust passage 38 establishes flow communication between the valve chamber 19 and the exhaust chamber 11 (i.e., through the distributor valve passage 20 and the distributor port 21). As best shown in FIG. 8, the flow area of the exhaust passage 38 is significantly larger than the flow area of the valve vent 12 of known venting systems, such that pressurized fluid in the valve chamber 19 is evacuated to the exhaust chamber 11 sufficiently rapidly to ensure opening of the valve 16 at the desired point in the movement of the piston 32 in the return direction 3B.

Figure 9:
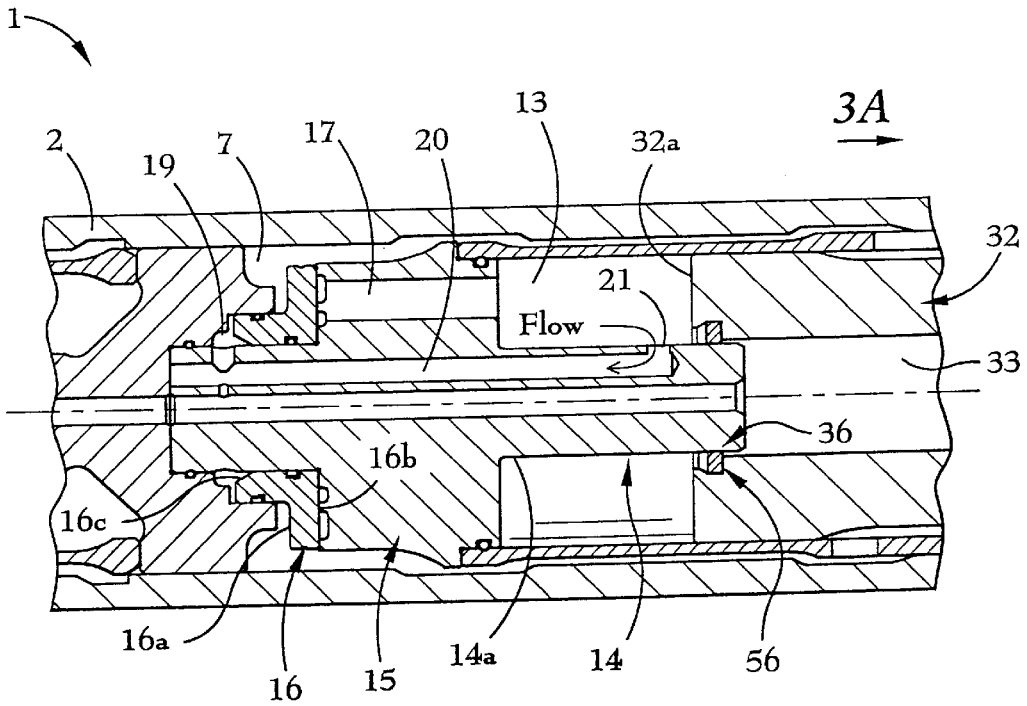
FIG. 9 is another view of the system depicted in FIG. 5, showing the piston moving in the drive direction with the sealing surface in a valve chamber fluid-supplying position.

Referring now to FIG. 9, after the valve 16 has "opened" and the piston 32 is caused to move in the drive direction 3B by the flow of pressurized fluid from the supply chamber 7 (as discussed in the Background section), the sealing surface 36 passes across the distributor port 21 from the second side 21*b* to the first side 21*a*, such that the flow communication is established between the drive chamber 13 and the valve chamber 19. Thereafter, pressurized fluid from the drive chamber 13 flows into the valve chamber 19 such that the valve chamber pressure increases (as the drive chamber pressure decreases) until the net force on the valve 16 causes the valve 16 to close (i.e., to become disposed against the valve seat 18). The closing of the valve 16 (not depicted), which preferably occurs when the second or lower end 32*b* of the piston 32 is proximal to the bit 5 (FIG. 10), prevents the flow of percussive fluid from the supply chamber 7 and into the valve chamber 13.

The first and second alternative constructions of the improve piston 32 function generally identically, except for the following difference. With the second construction having the ring seal 56, the ring seal 56 has a portion that is exposeable to fluid pressure within the drive chamber 13 when the seal 56 is engaged with the distributor outer surface 14*a*, namely the radial surface 56*c* which faces generally toward the first end 32*a* of the piston 32 (FIG. 8). As discussed above, the ring seal 56 is configured such that a pressure differential between the drive chamber 13 and the exhaust chamber 11 causes the sealing surface 56*a* to exert pressure against the outer surface 14*a* of the distributor guide portion 14. The pressurized contact between the ring surface 56*a* and distributor outer surface 14*a* increases the efficiency of the seal formed between the piston 32 and the distributor 15 as the pressure in the drive chamber 13 increases.

Both the first and second constructions of the improved piston 32 have the benefit of enabling the venting and sealing system 30 to be significantly less sensitive to any increases of the clearance between the piston 32 and distributor 15 caused by wearing or galling of the piston interior surface 34 or the distributor outer surface 14*a*. This benefit is derived from the fact the exhaust passage 38 has a substantially larger flow area than the valve vent 12 of prior known systems, such that a significantly greater rate of flow from the valve chamber 19 to the exhaust chamber 11 is achieved if any leakage flow to the valve chamber 19 should occur. Further, due to the location of the exhaust passage 38, any leakage flow from the drive chamber 13 (though unlikely to occur) is directed into the exhaust passage 38 rather than into the distributor valve passage 20. Thus, any leakage flow is substantially "vented away" to the exhaust chamber 11 rather than flowing into the valve chamber 19 as occurs with previously known valve systems. Furthermore, due to the elimination or significant reduction in size of the valve vent 12, there is no loss or "bleeding away" of pressurized fluid from the valve chamber 19 when pressure is needed to close the valve 16 at the desired point of the piston travel.

Another advantage of the second construction of the improved piston 32 is that the ring seal 56 is formed of a material such that no lubrication is necessary between the piston 32 and the distributor 15. Further, the use of the ring seal 56 to seal the space between the piston 32 and the distributor 15 permits the second construction piston 32 to be formed with a relatively substantial spacing between the piston body interior surface 50 and the guide portion outer surface 14*a*. Therefore, there is no metal-to-metal contact between the piston 32 and the distributor 15 with the second piston construction such that no galling or wearing of either component occurs. Furthermore, the ring seal 56 has a significantly lower hardness than the distributor outer surface 14*a*, so that the seal 56 rather than distributor 15 becomes worn. The ring seal 56 is much easier and less expensive to replace as compared with repairing or replacing the distributor 15.

It will be appreciated by those skilled in the art that changes could be made to the embodiments described above without departing from the broad inventive concept thereof. For example, the present invention is depicted and described with reference to a down-hole drill, the venting and sealing system and improved piston 32 of the present invention are equally applicable to an "out-of-hole" drill (i.e., with a drill assembly that does not operate primarily subterraneously), such applications being embraced within the scope of the present invention. It is understood, therefore, that this invention is not limited to the particular embodiments disclosed, but it is intended to cover modifications within the spirit and scope of the present invention as defined by the appended claims.

We claim:

1. A sealing and venting system for a drill assembly including a casing, a fluid distributor disposed within the casing and including an elongated guide portion having an outer surface, a piston slidably disposed within the casing and having first and second ends and an interior surface defining a passage between the piston ends, the piston interior surface being disposeable about the outer surface of the guide portion, the system comprising:

a sealing surface disposed within the piston passage and slidably engageable with the outer surface of the guide portion so as to provide a seal between the piston and the distributor; and an exhaust passage defined by sections of the interior surface of the piston and of the outer surface of the guide portion when the guide portion is disposed within the piston passage, the passage extending between the sealing surface and the second end of the piston.

2. The system as recited in claim 1 wherein:

the drill assembly further includes a valve chamber, an exhaust chamber and a drive chamber each defined within the casing, the exhaust chamber being in fluid communication with the piston passage, the drive chamber being fluidly communicable with the valve chamber and with the exhaust chamber;

the distributor has a passage extending through the guide portion, the distributor passage being in fluid communication with the valve chamber, and a port extending between the outer surface and the distributor passage; and the sealing surface substantially prevents fluid communication between the drive chamber and exhaust chamber when the sealing surface engages the outer surface of the guide portion on a first side of the distributor port and the exhaust passage establishes fluid communication between the valve chamber and exhaust chamber through the distributor and piston passages when the sealing surface engages the outer surface of the guide portion on a second, opposing side of the distributor port.

3. The system as recited in claim 2 wherein the drive chamber and the valve chamber are in fluid communication when the sealing surface is disposed on the first side of the distributor port.

4. The system as recited in claim 1 wherein the sealing surface is provided by ring seal disposed within the piston passage.

5. The system as recited in claim 4 wherein:

the drill assembly further includes a drive chamber defined within the casing; and the ring seal has a portion exposeable to fluid pressure within the drive chamber and is configured such that a pressure differential between the drive chamber and the exhaust chamber causes the sealing surface to exert pressure against the outer surface of the distributor guide portion.

6. The system as recited in claim 4 wherein:

the piston includes an annular recess extending circumferentially into the piston from the interior surface; and the ring seal is disposed within the annular recess and has a radial surface extending from the recess and into the piston passage such that the exhaust passage is partially bounded by the radial surface of the ring seal and by a section of the piston interior surface extending between the ring seal and the second end of the piston.

7. The system as recited in claim 1 wherein the piston has a central axis and the piston interior surface includes:

a first, circumferential surface section generally centered about the central axis, located proximal to the first end of the piston and providing the sealing surface;

a second, circumferential surface section located between the first surface section and the second end of the piston and spaced from the central axis so as to be disposed radially outwardly with respect to the first surface section; and a third, radially-extending surface section extending between the first and second surface sections such that the exhaust passage is partially bounded by the second and third surface sections.

8. A sealing and venting system for a drill assembly including a casing, a fluid distributor disposed within the casing and including an elongated guide portion having an outer surface, a passage extending through the guide portion and a port extending between the outer surface of the guide portion and the passage, a piston slidably disposed within the casing and having first and second ends and an interior surface defining a passage between the piston ends, the piston interior surface being disposeable about the outer surface of the guide portion, a valve chamber defined within the casing and in fluid communication with the distributor passage, an exhaust chamber defined within the casing and in fluid communication with the piston passage, and a drive chamber defined within the casing and fluidly communicable with the valve chamber and with the exhaust chamber, the system comprising:

a sealing surface disposed within the piston passage and slidably engageable with the outer surface of the guide portion; and an exhaust passage between the interior surface of the piston and the outer surface of the guide portion and extending between the sealing surface and the second end of the piston;

wherein the sealing surface substantially prevents fluid communication between the drive chamber and the exhaust chamber when the sealing surface engages the outer surface of the guide portion on a first side of the distributor port and the exhaust passage establishes fluid communication between the valve chamber and the exhaust chamber through the distributor and piston passages when the sealing surface engages the outer surface of the guide portion on a second, opposing side of the distributor port.

9. The system as recited in claim 8 wherein fluid communication is established between the drive chamber and the valve chamber when the sealing surface moves from the second side of the distributor port to the first side of the distributor port.

10. The system as recited in claim 8 wherein the piston includes:

an annular recess extending circumferentially into the piston from the interior surface; and a ring seal disposed within the annular recess and having an inner circumferential surface providing the sealing surface.

11. The system as recited in claim 10 wherein the ring seal includes a radial surface extending from the recess and into the piston passage such that the exhaust passage is partially bounded by the radial surface of the ring seal and a section of the interior piston surface extending between the ring seal and the second end of the piston.

12. The system as recited in claim 8 wherein the piston has a central axis and the piston interior surface includes:

a first, circumferential surface section located proximal to the first end of the piston, generally centered about the central axis and providing the sealing surface;

a second, circumferential surface section located between the first surface section and the second end of the piston and spaced from the central axis so as to be disposed radially outwardly with respect to the first surface section; and a third, radially-extending surface section located between the first and second surface sections, the exhaust passage being partially bounded by the second and third surface sections.

13. A piston for a drill assembly including a fluid distributor, the distributor including an elongated guide portion having an outer surface, the piston comprising:

a body having a first end, a second end and an interior surface defining a passage extending between the two ends, the interior surface being disposeable about the outer surface of the guide portion and including:

a first surface section located proximal to the first end of the body, having a generally cylindrical shape and a generally constant inner diameter, and being slidably engageable with the guide portion outer surface so as to provide a floating seal between the piston and the distributor; and a second surface section located between the first surface section and the second end of the body and having at least one inner diameter, the second section inner diameter being greater than the first section inner diameter.

14. The piston as recited in claim 13 wherein the second surface section has a generally cylindrical shape.

15. The piston as recited in claim 13 wherein the piston further comprises:

an annular recess extending circumferentially into the piston from the interior surface; and the first surface section is provided by a ring seal disposed within the annular recess.

16. A piston for a drill assembly including a casing and an elongated guide member having an outer surface, the piston comprising:

a body having a first end, a second end and an interior surface defining a passage extending between the first and second ends, the interior surface being disposeable about the outer surface of the guide member; and a ring seal disposed within the piston passage and having a sealing surface slidably engageable with the outer surface of the guide member so as to provide a floating seal between the piston and the guide member.

17. The piston as recited in claim 16 wherein the piston further comprises an annular recess extending circumferentially into the piston from the interior surface, the ring seal being disposed within the annular recess.

18. The piston as recited in claim 16 wherein the drill assembly further includes a fluid distributor providing the elongated guide member.

19. A venting and sealing system for a drill assembly including a casing, a fluid distributor disposed within the casing and including an elongated guide portion having an outer surface and a passage extending through the guide portion, a piston slidably disposed within the casing and having first and second ends and an interior surface defining a passage between the piston ends, the piston interior surface being disposable about the outer surface of the guide portion, a valve chamber in fluid communication with the distributor passage, an exhaust chamber in fluid communication with the piston passage, a valve contactable with the distributor and exposed to the valve chamber, and a drive chamber fluidly communicable with the valve chamber and exhaust chamber, the system comprising:

sealing means for substantially preventing fluid communication between the drive chamber and the exhaust chamber when the piston is at a first, distal position with respect to the valve; and passage means for establishing fluid communication between the valve chamber and the exhaust chamber when the piston is at a second, proximal position with respect to the valve.

20. The system as recited in claim 19 wherein the sealing means enable fluid pressure within the valve chamber to increase during movement of the piston from the first position to the second position such that the valve is moved in a direction generally away from the distributor.

21. The system as recited in claim 19 wherein:

the distributor includes a port extending between the distributor outer surface and the distributor passage, the passage means being communicable with the distributor port; and the passage means are in fluid communication with the distributor passage when the sealing means engage the distributor outer surface on second, opposing side of the distributor port.

22. The system as recited in claim 19 wherein fluid communication is established between the drive chamber and the valve chamber when the sealing means moves from the second position with respect to the valve to the first position with respect to the valve.

* * * * *